US006062342A

United States Patent [19]

Dobson

[11] Patent Number: 6,062,342

[45] Date of Patent: May 16, 2000

[54] RESCUE DEVICE FOR A CONFINED SPACE AND METHOD OF USING THEREOF

[76] Inventor: Dale Dobson, 991 McCubbin Rd., Hodgenville, Ky. 42748

[21] Appl. No.: 08/856,044

[22] Filed: May 14, 1997

Related U.S. Application Data

[63] Continuation-in-part of application No. 08/534,708, Sep. 27, 1995, abandoned.

[51] Int. Cl.[7] ..... A62B 37/00

[52] U.S. Cl. ..... 182/230

[58] Field of Search ..... 249/48, 51; 52/738.1, 52/737.5, 737.4, 736.4, 736.3, 723.2, 723.1, 721.5, 721.4, 742.14, 745.17; 248/99, 174, 346.3, 346.5; 211/195; 182/230

[56] References Cited

U.S. PATENT DOCUMENTS

| | | | |
|---|---|---|---|
| 985,605 | 2/1911 | Konopinski | 52/723.2 |
| 2,897,553 | 8/1959 | Gorrow | 52/723.2 |
| 3,682,434 | 8/1972 | Boenig | 249/48 |
| 3,798,867 | 3/1974 | Starling | 52/721.4 |
| 3,874,179 | 4/1975 | Higashihara | 61/46 |
| 4,023,374 | 5/1977 | Colbert et al. | 52/721.5 X |
| 4,244,156 | 1/1981 | Watts, Jr. | 52/736.4 X |
| 5,065,891 | 11/1991 | Casey | 248/99 X |
| 5,226,554 | 7/1993 | Dauphinais | 248/99 X |
| 5,591,263 | 1/1997 | Chin | 47/24 |

*Primary Examiner*—Alvin Chin-Shue
*Attorney, Agent, or Firm*—Robin, Blecker & Daley

[57] ABSTRACT

A rescue device for assisting in removing an individual from a confined space comprises a sheet having a first end with one or more through apertures and a sheet section extending from the first end having one or more through apertures and a securing device for securing the sheet section and the first end together. The sheet section is adapted to curl around so as to selectively bring a through aperture of the sheet section adjacent to a through aperture of the first end thereby to form an enclosure of a selective dimension. The securing device secures the sheet section and the first end together when the through aperture of the sheet section is in corresponding arrangement with the through aperture of the first end.

13 Claims, 2 Drawing Sheets

RESCUE DEVICE FOR A CONFINED SPACE AND METHOD OF USING THEREOF

This is a continuation application under 37 CFR 1.62 of prior application Ser. No. 08/534,708, filed Sep. 27, 1995, abandoned.

Field of the Invention

This invention relates generally to rescue devices, and in particular, to an adjustable rescue device for assisting in rescuing individuals who are trapped in a confined area or space.

BACKGROUND OF THE INVENTION

Many farm accidents occur during the removal of grain, seed, or other granular substances from bins and silos. For example, when grain flowing out of a silo is not properly funneling out of the silo and/or becomes lodged therein, this hinders the removal process of the grain from the silo.

Individuals will often go inside the silo and stand on top of the grain pile to push the grain downward in order to maintain a flow of grain out of the silo. Sometimes, if the grain begins to flow downward too rapidly, this flow increase will create a "whirlpool" effect. Then the individual standing on top of the grain pile will be caught in this sudden whirlpool effect and be pulled downward into the flow of grain. If the individual is not immediately pulled out, the individual will continue to be pulled downward into the grain by the whirlpool effect which can possibly lead to suffocation and death of the individual.

Accordingly over the years, devices have been developed to assist in rescuing individuals trapped in granular substances inside a silo or bin. One type of device devised for rescuing trapped individuals includes a bottomless barrel which is split in thirds and which is then assembled inside of the silo by taping the panels of the barrel together. The taped barrel is then placed above the trapped individual and pushed downward to move the grain away from the individual to allow for the individual to be dug out.

This device, however, has several limitations. Since the device comprises a number of large rounded panels, the size and configuration of the panels hinder the movement of the rescuer through narrow passages to reach the trapped individual. Further, since the diameter of the device is fixed, this results in a device which is not adjustable or easily portable to allow for easy passage through narrow entryways nor does it allow the device to be adjustable in size depending upon the size of the individual trapped. In addition, based upon the configuration of the device, it does not provide a solid support structure and is awkward to assemble and position during an emergency situation.

Accordingly, improved rescue devices are still being sought to assist in removing individuals from confined areas and spaces. Specifically, adjustable rescue devices, designed for quick assembly and positioning during a rescue, particularly in a small or confined area or space, are being sought.

It is therefore an object of the present invention to provide a rescue device which can be easily adjustable in size.

It is a further object of the present invention to provide a rescue device which is easy to assemble and position around an individual during a rescue.

It is an additional object of the present invention to provide a rescue device which is economical to manufacture and simple in design.

SUMMARY OF THE INVENTION

In accordance with the principles of the present invention, the above and other objectives are realized in a rescue device for assisting in removing an individual from a confined space which comprises a sheet having a first end with one or more through apertures and a sheet section extending from the first end having one or more through apertures and a securing device for securing the sheet section and the first end together. The sheet section is adapted to curl around so as to selectively bring a through aperture of the sheet section adjacent to a through aperture of the first end thereby to form an enclosure of a selective dimension. The securing device secures the sheet section and the first end together when the through aperture of the sheet section is in corresponding arrangement with the through aperture of the first end.

In a modified form of the rescue device of the invention, the sheet section of the device has one or more protruding members and is adapted to curl around so as to selectively bring a protruding member adjacent to the first end. The first end has bracket members with engaging members adapted to engage with the protruding member included in the sheet section brought adjacent to the first end when the sheet section is curled around thereby to form an enclosure of a selective dimension and to secure the sheet section and the first end together when the protruding member of the sheet section is in corresponding engagement with the engaging member of the bracket member of the first end.

BRIEF DESCRIPTION OF THE DRAWINGS

The above and other features and aspects of the present invention will become more apparent upon reading the following detailed description in conjunction with the accompanying drawings, in which.

DETAILED DESCRIPTION

Figure 1:
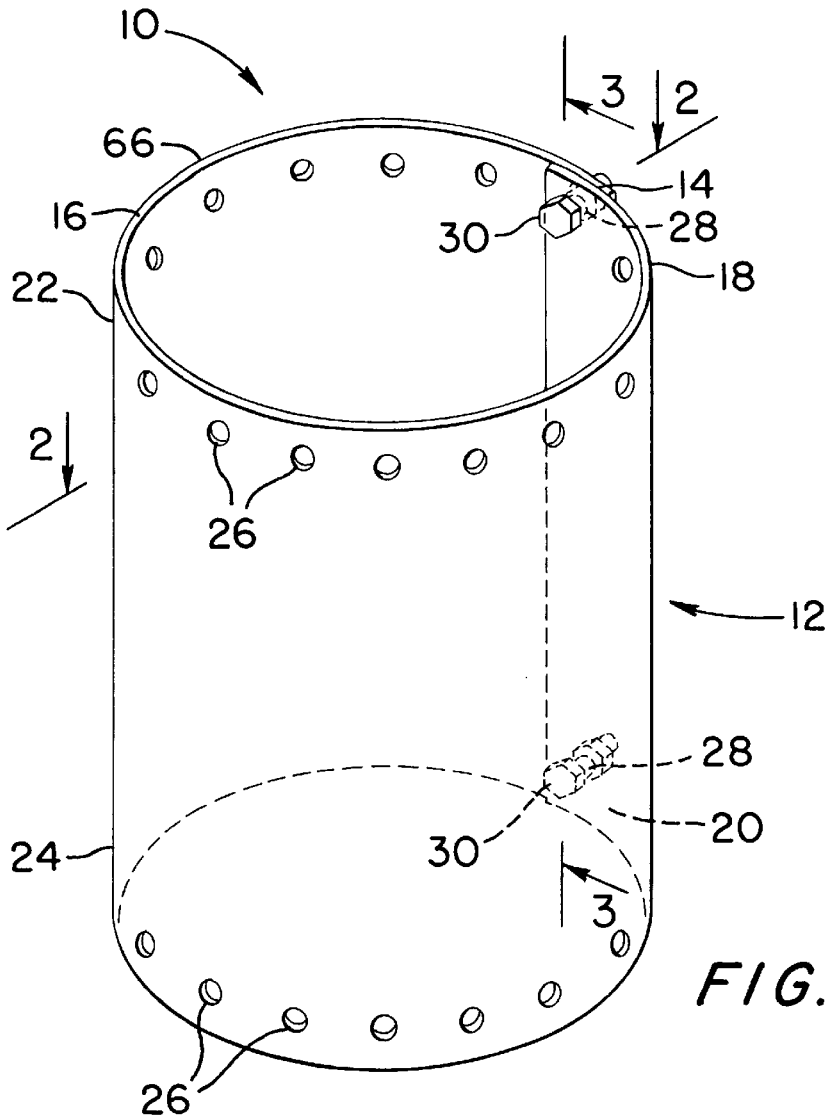
FIG. 1 shows a perspective view of a rescue device in accordance with the principles of the present invention.

FIG. 1 shows a rescue device 10 in accordance with the principles of the invention. The rescue device 10 is an adjustable device used by rescue workers to remove an individual trapped in granular material or substances in a confined area or space. For example, the rescue device 10 is especially useful in farm environments to assist in rescuing individuals trapped in a "whirlpool" of grain caused by a sudden rush of grain out of a silo.

The rescue device 10 comprises a sheet 12 which is a flexible material and can be rolled or curled to form a tube-like shape. Based upon the flexibility of the sheet 12, a rescue worker can roll the sheet 12 of the device 10 to any desired diameter. This adjustability not only allows for the device 10 to be reduced in diameter to allow for easy entry into a narrow passage or confined space but also permits adjustability of the diameter of the device 10 to permit the diameter of the device 10 to be sized according to the size of the individual trapped.

The sheet 12 of the device 10 has a first end 14 and a sheet section 16 extending from the first end 14. The first end 14 has upper and lower portions 18 and 20 and the sheet section 16 also has upper and lower portions 22 and 24 in corresponding arrangement to the upper and lower portions 18 and 20 of the first end 14.

The sheet section 16 has first receiving means or one or more first apertures 26 which are located in the upper and lower portions 22 and 24 of the sheet section 16. The first end 14 has second receiving means or one or more second apertures 28 which are located in the upper and lower portions 18 and 20 of the first end 14. The first apertures 26 in the upper and lower portions 22 and 24 of the sheet section 16 extending horizontally from the second apertures 28 are in a spaced predetermined relationship. The sheet section 16 is adapted to curl around so as to selectively bring the first apertures 26 of the sheet section 16 adjacent to the second apertures 28 of the first end 14 thereby to form an enclosure of a selective dimension. The corresponding parallel arrangement of the first and second apertures 26 and 28 and alignment thereof allow for easy adjustment of the rescue device 10 to a variety of diameters.

Figure 2:
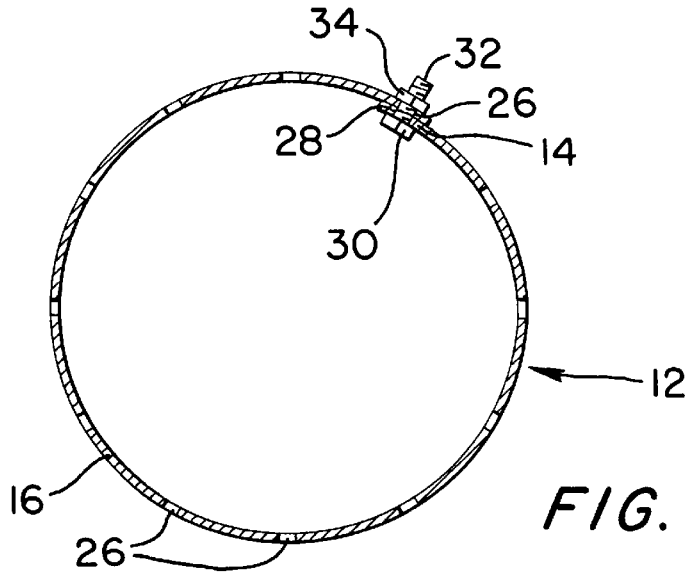
FIG. 2 shows a cross-sectional view of the rescue device of FIG. 1 along the line 2—2 of FIG. 1.
Figure 3:
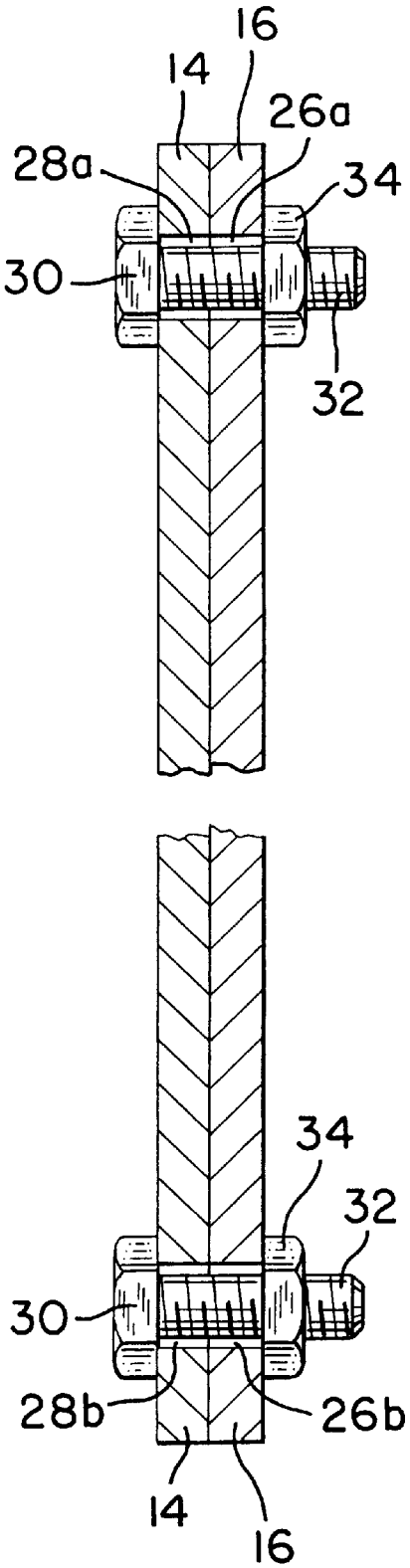
FIG. 3 shows an enlarged cross-sectional view partially cut away of a securing device of the rescue device along the line 3—3 of FIG. 1.

As shown generally in FIGS. 1–2 and more particularly in FIG. 3, securing means or device 30 extends through each first and second through apertures 26 and 28 to secure and fasten the sheet section 16 and the first end 14 together when a first through aperture 26*a* in the upper portion 22 of the sheet section 16 is in corresponding arrangement with a second through aperture 28*a* in the upper portion 18 of the first end 14 and a first through aperture 26*b* in the lower portion 24 of the sheet section 16 is in corresponding arrangement with a second through aperture 28*b* in the lower portion 20 of the first end 14.

The securing device 30 can have a variety of forms to provide for quick assembly of the rescue device 10 in a small or confined area as well as to provide a sturdy and strong support. As shown in FIGS. 1–3, the securing device 30 comprises rod-like members or bolts 32 and fastening means or nuts 34. The bolts 32 and nuts 34 secure the sheet section 16 and the first end 14 together when the second through apertures 28*a* and 28*b* of the first end 14 are in corresponding arrangement with the first through apertures 26*a* and 26*b* of the sheet section 16.

As shown in FIG. 3, the bolts 32 are inserted through the first apertures 28*a* and 28*b* of the first end 14 through the corresponding aligned second apertures 26*a* and 26*b* of the sheet section 16. Nuts 34 are then threaded and secured onto the bolts 32 to hold the bolts 32 in place thereby securing the first end 14 and the sheet section 16 together for secure engagement. In addition, the bolts 32 and nuts 34 positioned in the upper and lower portions in the first end 14 and sheet section 16 add to the support and sturdiness of the rescue device 10.

A rescue worker can then use the rescue device 10 in the following manner: for example, if an individual is trapped in a grain pile inside a silo, a rescue worker can enter through the narrow entry of the silo with the rescue device 10 in a rolled position. The worker then unrolls the rescue device 10 to a particular diameter based upon the size of the individual trapped in the grain. Bolts 32 are inserted through the first apertures 28*a* and 28*b* of the first end 14 through the corresponding aligned second apertures 26*a* and 26*b* of the sheet section 16 and nuts 34 are then threaded and fastened thereon to form a particularly sized rescue device 10. The rescue worker then positions the rescue device 10 above and around the trapped individual and pushes the device 10 downward into the grain. The downward movement and placement of the rescue device 10 around the individual stops the grain from further closing in on the individual and prevents possible suffocation. The rescue device 10, acting as a barrier between the grain and the individual, thereby permits the rescue worker to free the trapped individual by allowing the worker to dig the individual out.

Figure 4:
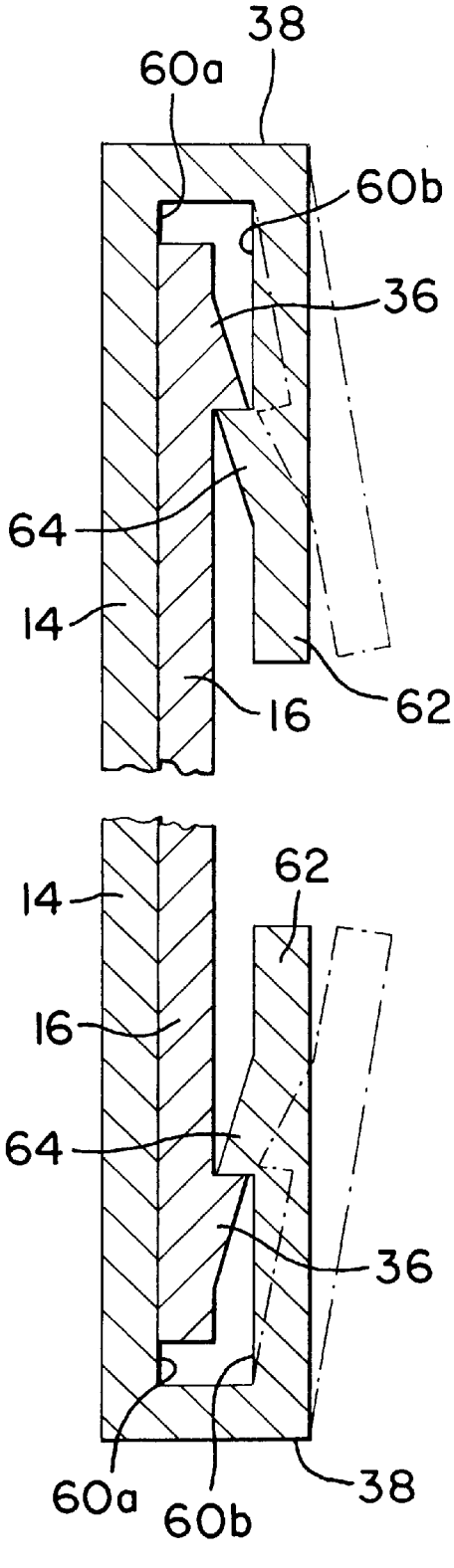
FIG. 4 shows an enlarged cross-sectional view partially cut away of a modified embodiment of the first end and sheet section of the rescue device of the present invention.

A modified embodiment of the rescue device 10 is shown in FIG. 4 where the sheet section 16 and the first end 14 have been modified to include first and second engagement means 36 and 38, respectively. First engagement means or one or more protruding members 36 are formed in the upper and lower portions 22 and 24 of the sheet section 16.

As shown in FIG. 4, second engagement means or bracket members 38 extend away from the upper and lower portions 18 and 20 of the first end 14 with each bracket member 38 forming an L-shaped configuration. Each bracket member 38 has spaced first and second walls 60*a* and 60*b* which form an enclosure and allow the sheet section 16 to pass therebetween. In addition, each bracket member 38 includes a flexible wall portion 62 with an engaging member 64. The flexible wall portion 62 helps to bring the protruding member 36 of the sheet section 16 into engagement with the engaging member 64 and to guide the sheet section 16 between the first and second walls 60*a* and 60*b* thereby to form an enclosure.

The flexibility of the wall portion 62 also permits the release of the engagement between the engaging member 64 of the bracket member 38 and the protruding member 36. The flexible wall portion 62 can be pulled or moved away so that the engaging member 64 is no longer in engagement with the protruding member 36. This allows the diameter of the rescue device 10 to be varied depending on the need as well as permit quick assembly during a rescue operation. In addition, the flexible wall portion 62 also permits for the re-engagement of the engaging member 64 with another protruding member if the diameter of the device 10 needs to be modified. Accordingly, this engagement of the protruding member 36 and the engaging member 64 is then such that movement of the sheet section 16 through the bracket member 38 is permitted and movement of the sheet section 16 out of the bracket member can be restricted.

In accordance with the present invention, the sheet 12 of the rescue device 10 is comprised of a one piece flexible plastic which is not only rollable but also provides a sturdy support when positioned around a trapped individual to act as a barrier between the individual and granular substances. The sheet 12 is also lightweight and easily portable and has smooth and level edges 66 thereby helping to reduce friction when the rescue device 10 is pushed into the granular substances, to provide an easier grasping surface as well as to ease engagement when the first end 14 and the sheet section 16 are brought together. The sheet 12, however, is not limited to the present embodiment, but can be any material which is easily adjustable can function as some type of barrier means. Further, the edging of the sheet 12 is also not limited to the illustrated embodiment but can have any variety of edges and configurations, i.e., straight, rounded, beveled, contoured, notched, etc.

With respect to receiving means and engagement means of the present invention, such means are not limited to the present embodiment, but may be any type of means, such as prongs, indentations, projections, etc., that allow for easy assembly of a rescue device 10 in a time of emergency. In addition, any number of receiving means and engagement means can be used in the rescue device 10 and can be located and spaced in any portion of the sheet 12 and in any type of configuration. Further, the securing means can also be any type of device for securing the first end 14 and sheet section 16 together, such as carabiners, fasteners, etc.

The rescue device 10 of the present invention is not limited to use in a farm environment but has many applications in other environments, such as industrial environments, cave or mining environments, etc. In addition, the rescue device 10 can be used in a variety of different materials or substances, such sand, dirt, etc., plastic materials, and dry or semi-dry materials, etc.

In all cases it is understood that the above-described arrangements are merely illustrative of the many possible specific embodiments which represent applications of the present invention. Numerous and varied other arrangements, can be readily devised in accordance with the principles of the present invention without departing from the spirit and scope of the invention.

What is claimed is:

1. A rescue device to assist in removing an individual trapped in material in a confined space, said rescue device comprising:

a sheet having a first end and a sheet section extending from said first end, said first end having upper and lower portions and said sheet section having upper and lower portions in corresponding arrangement to the upper and lower portions of said first end, said sheet section having first engagement means and being adapted to curl around so as to selectively bring said first engagement means adjacent to said first end, and said first end having second engagement means adapted to engage with the first engagement means included in said sheet section brought adjacent to said first end when said sheet section is curled around thereby to form an enclosure of a selective dimension adapted for insertion into the material to act as a barrier between the material and the trapped individual, said second engagement means securing the enclosure by securing said sheet section and said first end together when the first engagement means of the sheet section is in corresponding engagement with the second engagement means of the first end, said second engagement means comprising bracket members located in the upper and lower portions of said first end and said first engagement means comprising at least one protruding member located in the upper and lower portions of said sheet section, each bracket member comprising spaced first and second walls which said sheet section is passed to form the enclosure, said second wall including a flexible wall portion, said wall portion including an engaging member for permitting engagement of a protruding member of said first engagement means with the engaging member between said first and second walls of said each bracket member to form said enclosure and said wall portion permitting for release of the engagement of the protruding member with the engaging member.

2. A device in accordance with claim 1, wherein the engagement of the protruding member and the engaging member is such that movement of the sheet section through said bracket members is permitted and movement of the sheet section out of the bracket members is restricted.

3. A device in accordance with claim 2, wherein said sheet is a one-piece shell.

4. A device in accordance with claim 3, wherein said sheet is plastic.

5. A device in accordance with claim 1, wherein said sheet is a one-piece shell.

6. A method for assisting in removing an individual trapped in material in a confined space, comprising the steps of:

positioning a rescue device around the trapped individual, said rescue device comprising a sheet having a first end and a sheet section extending from said first end, said sheet section having first receiving means and being adapted to curl around so as to selectively bring said first receiving means adjacent to said first end, said first end having second receiving means adapted to correspond with the first receiving means included in said sheet section brought adjacent to said first end when said sheet section is curled around thereby to form an enclosure of a selective dimension adapted for insertion into the material to act as a barrier between the material and the trapped individual, and securing means for securing the enclosure by securing said sheet section and said first end together when the first receiving means of the sheet section is in corresponding arrangement with the second receiving means of the first end; and inserting the enclosure of the rescue device into the material in the confined space to place the enclosure adjacent to and around the trapped individual to provide a barrier between the material and the trapped individual to allow the trapped individual to be removed from the material in the confined space.

7. A method in accordance with claim 6, wherein said first end has upper and lower portions and said sheet section has upper and lower portions in corresponding arrangement to the upper and lower portions of said first end, and said first receiving means includes at least one first through aperture in the upper and lower portions of said sheet section and said second receiving means includes at least one second through aperture in the upper and lower portions of said first end.

8. A method in accordance with claim 6, wherein said securing means extends through said at least one first and second through apertures for securing and fastening said sheet section and said first end together when a first through aperture in the upper portion of the sheet section is in corresponding arrangement with a second through aperture in the upper portion of the first end and a first through aperture in the lower portion of the sheet section is in corresponding arrangement with a second through aperture in the lower portion of the first end.

9. A method in accordance with claim 8, wherein said securing means includes a rod-like member which extends through the first through aperture in the upper portion of the sheet section and through the second through aperture in the upper portion of the first end and a rod-like member which extends through the first through aperture in the lower portion of the sheet section and through the second through aperture in the lower portion of the first end and fastening means for securing the rod-like members thereto.

10. A method in accordance with claim 6, wherein said sheet is a one-piece shell.

11. A method for assisting in removing an individual trapped in material in a confined space, comprising the steps of:

positioning a rescue device around the trapped individual, said rescue device comprising a sheet having a first end and a sheet section extending from said first end, said sheet section having first engagement means and being adapted to curl around so as to selectively bring said first engagement means adjacent to said first end, and said first end having second engagement means adapted to engage with the first engagement means included in said sheet section brought adjacent to said first end when said sheet section is curled around thereby to form an enclosure of a selective dimension adapted for insertion into the material to act as a barrier between the material and the trapped individual, said second engagement means securing the enclosure by securing said sheet section and said first end together when the first engagement means of the sheet section is in corresponding engagement with the second engagement means of the first end; and inserting the enclosure of the rescue device into the material in the confined space to place the enclosure adjacent to and around the trapped individual to provide a barrier between the material and the trapped individual to allow the trapped individual to be removed from the material in the confined space.

12. A method in accordance with claim 11, wherein the engagement of the protruding member and the engaging member is such that movement of the sheet section through said bracket members is permitted and movement of the sheet section out of the bracket members is restricted.

13. A method in accordance with claim 11, wherein said sheet is a one-piece shell.

* * * * *

UNITED STATES PATENT AND TRADEMARK OFFICE

CERTIFICATE OF CORRECTION

PATENT NO. : 6,062,342
DATED : May 16, 2000
INVENTOR(S) : Dale Dobson

It is certified that error appears in the above-identified patent and that said Letters Patent is hereby corrected as shown below:

On the title page, item 63, the text reading "Continuation-in-part of application No. 08/534,708, Sep. 27, 1995, abandoned." should be changed to --Continuation application under 37 CFR 1.62 of prior application No. 08/534,708, filed September 27, 1995, abandoned.--

Signed and Sealed this

Eighth Day of May, 2001

*Attest:*

Nicholas P. Godici

NICHOLAS P. GODICI

*Attesting Officer*

*Acting Director of the United States Patent and Trademark Office*